US008157677B1

(12) United States Patent
Chen

(10) Patent No.: US 8,157,677 B1
(45) Date of Patent: Apr. 17, 2012

(54) TABLE TENNIS CADDY

(76) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 13/190,835

(22) Filed: Jul. 26, 2011

(51) Int. Cl.
*A63B 61/00* (2006.01)

(52) U.S. Cl. ..... 473/490; 473/494; 211/13.1; 211/14

(58) Field of Classification Search ..... 473/490, 473/491, 494, 496; 211/13.1, 14
See application file for complete search history.

(56) References Cited

U.S. PATENT DOCUMENTS 2,767,854 A * 10/1956 Barrett ..... 211/85.7
3,064,823 A * 11/1962 Shock ..... 211/15
D246,340 S * 11/1977 Frank ..... D6/552
4,125,192 A * 11/1978 Dayen ..... 211/14
4,211,406 A * 7/1980 Roesler et al. ..... 473/491
D258,182 S * 2/1981 Thorne ..... D6/552
5,368,172 A * 11/1994 Barringer ..... 211/85.7
5,632,386 A * 5/1997 Gabhart ..... 211/85.7
5,810,681 A * 9/1998 Heim ..... 473/496

* cited by examiner

*Primary Examiner* — Raleigh W. Chiu
(74) *Attorney, Agent, or Firm* — Clement Cheng

(57) ABSTRACT

A table tennis caddy for mounting to a table tennis table includes a table tennis net assembly including a net mounted on a net frame. The net frame includes a net post extending upward. An outside connection mechanism underneath the net frame is disposed toward an exterior portion of the net frame. An inside connection mechanism underneath the net frame is disposed toward an interior portion of the net frame. A ball rack is mounted underneath the net frame. The ball rack is connected between the outside connection mechanism and the inside connection mechanism. A frame hook member connects to a bottom portion of the net frame.

20 Claims, 3 Drawing Sheets

TABLE TENNIS CADDY

FIELD OF THE INVENTION

The present invention is in the field of table tennis accessories.

DISCUSSION OF RELATED ART

Table tennis is typically played with a table tennis table, a pair of paddles and ping-pong balls. These table tennis accessories are typically left on the surface of a table or dumped in a bucket when not in use. A variety of table tennis accessory carriers allow portable carrying of table tennis accessories in a carry bag for example.

SUMMARY OF THE INVENTION

A table tennis caddy for mounting to a table tennis table includes a table tennis net assembly including a net mounted on a net frame. The net frame includes a net post extending upward. An outside connection mechanism underneath the net frame is disposed toward an exterior portion of the net frame. An inside connection mechanism underneath the net frame is disposed toward an interior portion of the net frame. A ball rack is mounted underneath the net frame. The ball rack is connected between the outside connection mechanism and the inside connection mechanism. A frame hook member connects to a bottom portion of the net frame.

A frame hook opening is formed on the frame hook member, and the outside connection mechanism is the frame hook opening which faces toward a table tennis table middle portion. A lower frame is connected underneath the net frame. The lower frame further includes a lower frame notch that faces the frame hook opening. The lower frame notch is the inside connection mechanism, and the ball rack is connected between the frame hook opening and the lower frame notch.

The frame hook is formed with a flat vertically oriented profile, such that the flat vertically oriented profile forms a pair of vertical planes. The frame hook is formed as a pair of metal members. The ball rack includes a pair of rails including a left rail and a right rail, each sized and shaped for supporting a left and right side of a ping-pong ball. The pair of rails have a slope such that table tennis balls roll toward a ball stop. The ball stop is made of metal having a spring resilience. The pair of rails have between them an intermediate connection which is a rail bridge.

The ball stop is bridged at a top connector, and the ball stop is connected to the pair of rails so that a right ball stop member is connected to the right rail and that a left ball stop member is connected to the left rail. The top connector is sized to connect to the outside connection mechanism. The lower frame bridge protrudes upward at a lower frame bridge protrusion so as to create a hook shaped opening where the lower frame bridge protrusion forms a tip of the hook shaped opening. The paddle holder is mounted below the ball rack and a bottle rack is mounted to the ball rack.

Figure 1:
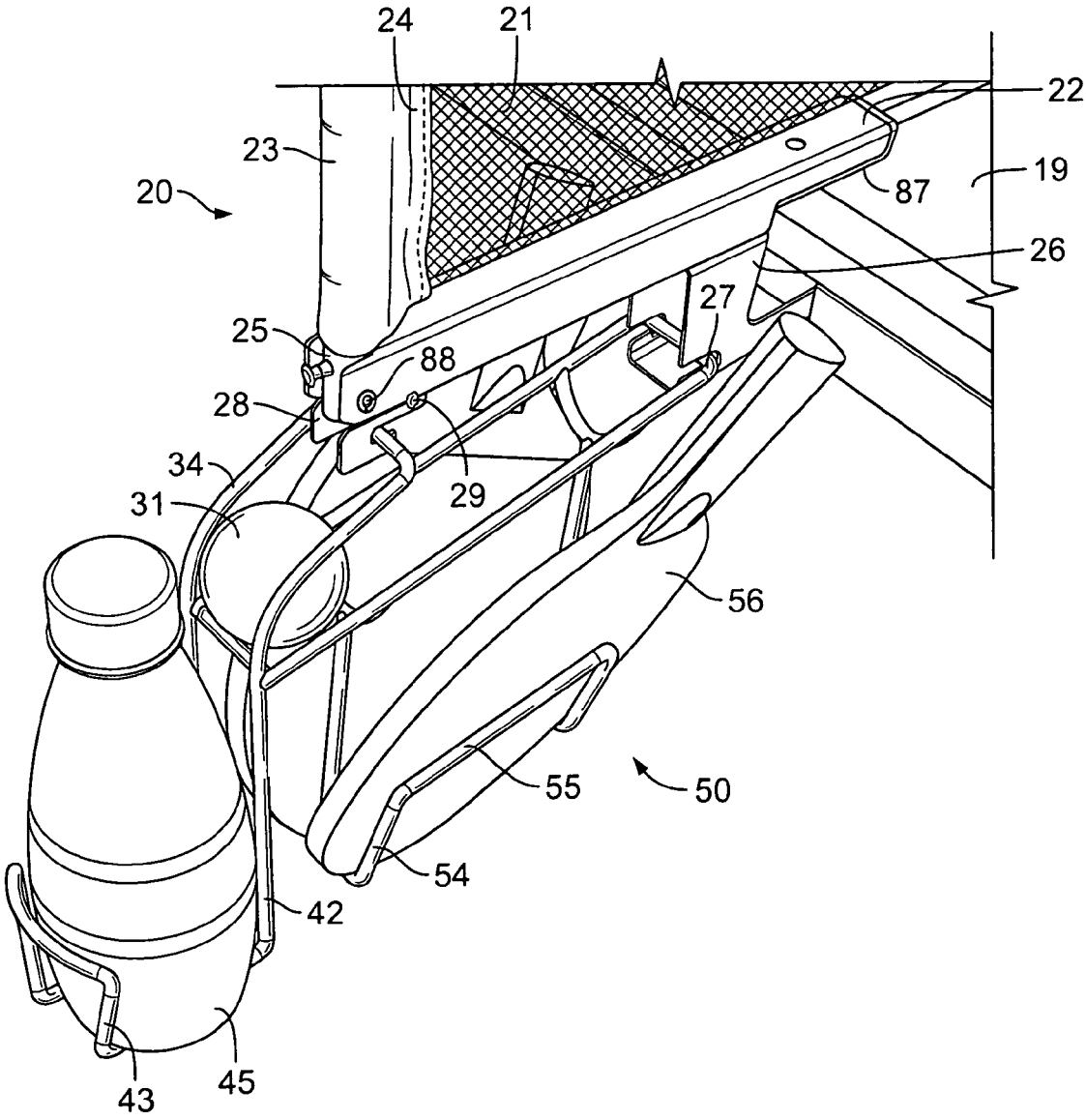
FIG. 1 is a perspective view of the table tennis caddy.
Figure 2:
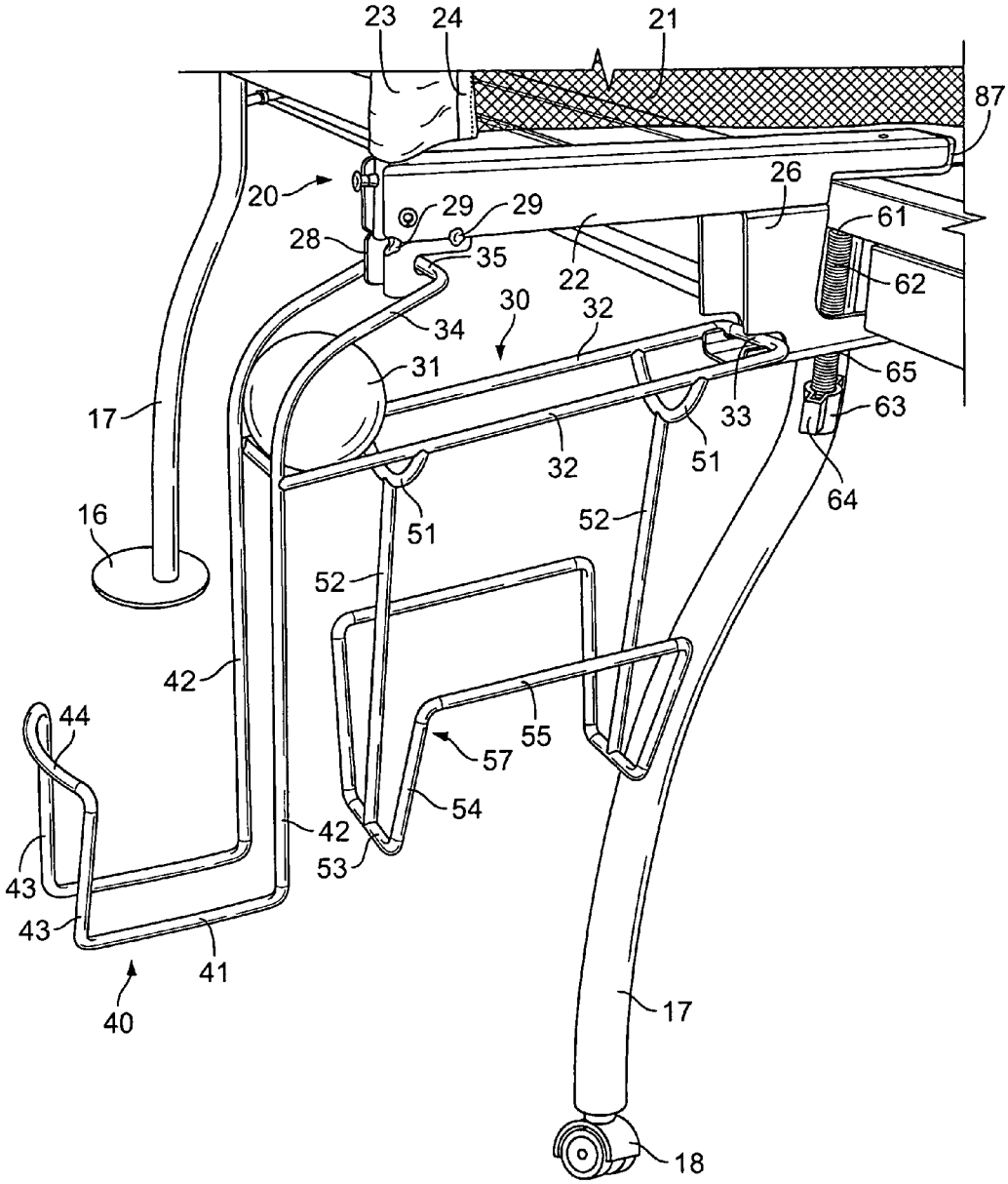
FIG. 2 is a side perspective view of the table tennis caddy.
Figure 3:
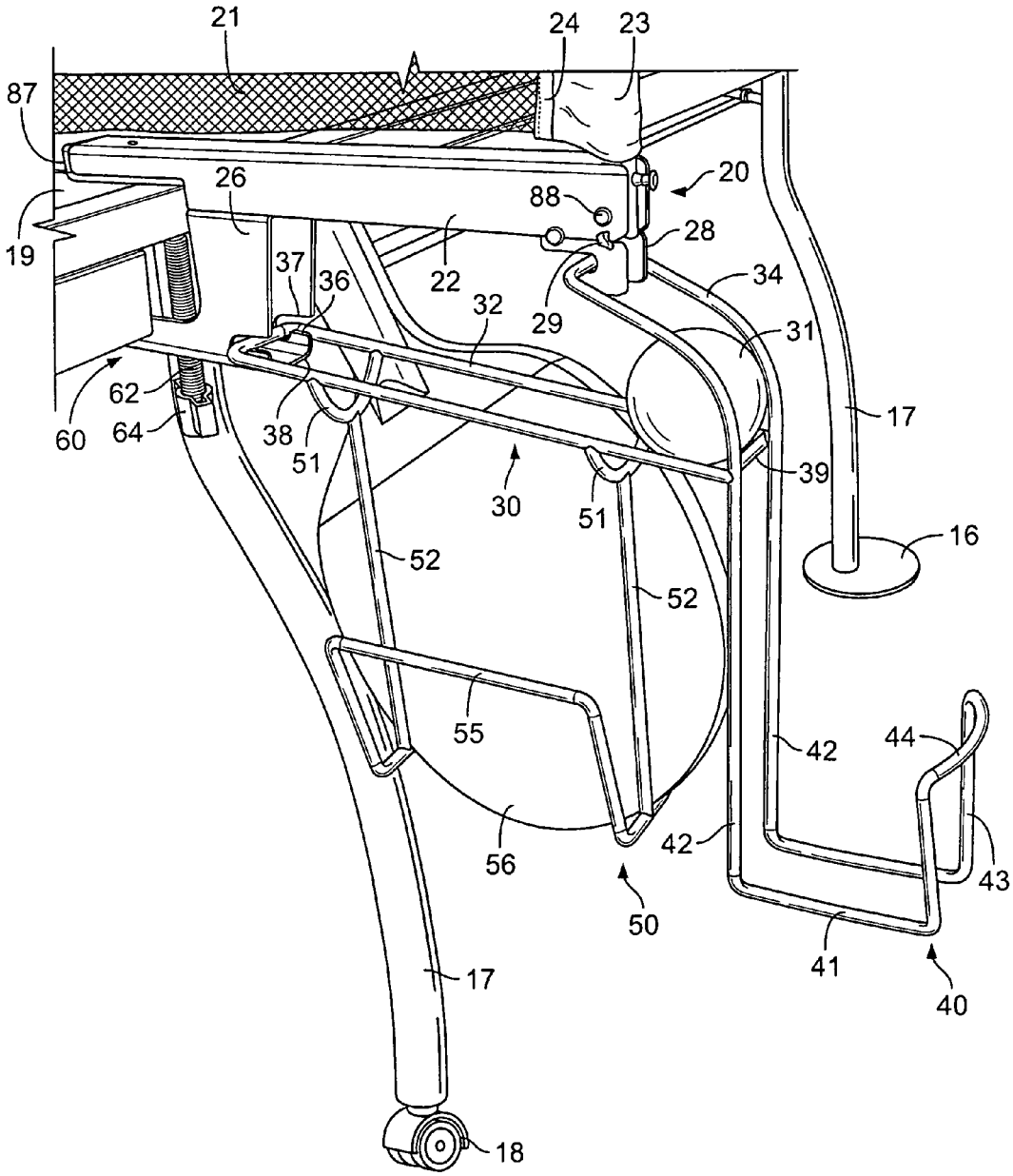
FIG. 3 is a perspective view of the table tennis caddy.

The following call out list of elements is a useful guide in referencing the elements of the drawings.

16 Feet
17 Leg

18 Wheel
19 Table
21 Table Tennis Net
20 Net Assembly
22 net Frame
23 Net Sleeve
24 Net Stitch
25 Net Post
26 Lower Frame
27 Lower Frame Notch
28 Frame Hook
29 Weld
31 Ball
32 Rail
30 Ball Rack
33 Lower Connector
34 Ball Stop
35 Top Connector
36 Lower Frame Bridge Protrusion
38 Lower Frame Bridge
39 Ball Holder Bridge
40 Bottle Holder
41 Bottle Horizontal Member
42 Bottle Holder Vertical Member
43 Bottle Holder Outer Member
44 Bottle Holder Tip
50 Paddle Holder
51 Paddle Yoke Connector
52 Paddle Holder Post
57 Paddle Holder Arm
56 Paddle
53 Arm Lever
54 Arm Vertical Member
55 Arm Bridge
60 Clamp
61 Bolt Tip
62 Bolt Thread
63 Bolt Knob
64 Knob Wings
65 Bolt Threaded Opening In Lower Frame
87 Clamp Grip
88 Swivel Pin Joint

DETAILED DESCRIPTION OF THE PREFERRED EMBODIMENT

A table tennis table has a plurality of foot 16 mounted on a plurality of legs 17. Some legs receive wheels 18 for portability of the table tennis table. The legs 17 support a horizontal table surface 19. A table tennis net 21 is mounted across the middle of the table tennis table. The table tennis net assembly 20 includes the net 21 and a net frame 22 upon which the net 21 is mounted. The net sleeve 23 is typically stitched at a sleeve stitch 24. The net post 25 may extend upwardly through the net sleeve 23. The net post can be made as a cylindrical post having a hollow cross-section which is circular. The net post is typically performed of a tubular material. The net post 25 can be formed of steel or metal. The net frame 22 supports the net post 25. The net post 25 may have a lower end that is connected to the net frame 22 at a pin joint 88. The lower portion of the net frame 22 may receive a clamp grip 87 formed as an elastomeric outer covering to the net frame 22 so that the net frame 22 grips to the surface of the table 19.

The lower portion of the net frame 22 may receive a connection such as a weld 29 or a screw to connect a frame hook member 28 to the bottom of the net frame 22 at the location underneath the net sleeve 23 and at the location underneath the net post 25. The frame hook 28 has a frame hook opening 35 facing toward the middle of the table and can be formed as a single or double hook having a flat vertically oriented profile. The flat vertically oriented profile forms a pair of vertical planes substantially bisecting the table 19 along the net 21. The frame hook 28 optionally formed as a pair can be made of metal and can be welded at more than one location to the net frame 22.

The lower frame 26 also has a hook opening 37 which is a lower frame notch 27. The lower frame notch 27 preferably faces the frame hook opening. The lower frame 26 preferably includes a lower frame bridge 38 connecting between the front and back faces of the lower frame 26. The lower frame bridge 38 may protrude upward at a lower frame bridge protrusion 36. The lower frame bridge protrusion 36 creates a hook shaped opening where the lower frame bridge protrusion 36 is a tip of the hook shaped opening.

Optionally, a clamp 60 can clamp the net assembly 20 to the table 19. The clamp 60 preferably includes a bolt having a bolt tip 61 engaging with and under side of the table 19. The bolt tip 61 is above bolt thread 62. The bolt thread 62 preferably passes through a bolt threaded opening in the lower frame 65 the lower frame opening 65 preferably has a right-handed thread orientation matching the right-handed bolt thread 62. The bolt thread 62 is pushed against the bolt threaded opening in the lower frame 65 when the bolt knob 63 is rotated. A user may rotate the bolt knob 63 by grasping a pair of knob wings 64. The knob wings 64 are preferably molded of plastic over a bottom head of the bolt at the opposite end of the bolt from the bolt tip 61. The knob wings 64 can be formed over the bolt by plastic injection over the bolt into a mold having knob wings.

The ball rack 30 is formed of a pair of rails 32. The pair of rails include a left and right rail each is supporting a left and right side of a ping-pong ball 31. The rail 32 has a slope which is outward so that the ball rolls up against a ball stop 34. The ball stop 34 is formed as a pair of heavy gauge metal wire having a spring resilience. The ball stop 34 stops the ball 31 at a left and right front portion of the ball. The ball stop 34 is bridged at a top connector 35. The top connector 35 is preferably integrally formed with the ball stop 34. The ball stop 34 is connected to the rail 32 such that the right ball stop member is connected to the right rail and that the left ball stop member is connected to the left rail. The pair of rails 32 has an intermediate connection which is a rail bridge 39.

The top connector 35 can be bent down so that the ball stop 34 is resilient bent to fit within top connector 35. The top connector 35 can be inserted into the frame hook opening. The top connector is a more general name for the heavy gauge wire shown as inserting into the frame hook opening. The top connector could be formed in other mechanical connection methods, for example the top connector could be magnetic so that it magnetizes to the top surface of the top connector 35 to form a magnetic connection. The pair of rails 32 also preferably has spring resilience so that they can resiliently deform to allow insertion of the lower connector 33 into the lower frame notch 27. The preferred method of insertion is to insert the lower connector 33 into the lower frame notch 27 and then to bend the rail 32 and in the ball stop 34 until they can be put into the frame hook 28. The ball rack 30 once retained between the lower frame notch and the frame hook 28 can be loaded with a number of ping-pong balls 31.

Optionally, the paddle holder 50 can receive a plurality of paddles. The paddle holder 50 is preferably supported at one or more paddle yoke connectors 51 which connect between the lower portion of the rails 32. A pair of paddle connectors may receive a pair of paddle holder posts 52 extending downward from a lower midpoint of the paddle yoke connectors 51. The paddle holder posts support a lower arm 53 extending from the paddle holder posts. The lower arm 53 can extend left and right and turn outward and upward at paddle holder arm vertical members 54. Four paddle holder arm vertical members 54 can extend from the four lower arms 53. A pair of left lower arms 53 and a pair of right lower arms 53 can support a pair of left paddle holder arm vertical members 54 and a pair of right paddle holder arm vertical members 54. The arm vertical members 54 are bridged at an arm bridge 55 so that the pair of left lower arms 53 are bridged at the left arm bridge 55 and so that the pair of right lower arms 53 are bridged at the right arm bridge 55. One or more paddles 56 can be stored in each paddle holder arm assembly.

Optionally, a bottle holder 40 can be attached to the ball rack 30. The bottle holder 40 preferably includes a pair of bottle holder vertical members 42 that may extend downward from the pair of ball stops 34. The pair of ball stops 34 can be formed of the same steel wire as the bottle holder vertical member 42. The pair of bottle holder vertical members 42 extend downward and terminate at a pair of bottle holder horizontal members 41 which extend outward away from the table tennis table. The bottle holder outer members then extend upward from the pair of bottle holder horizontal members. The pair of upwardly extending bottle holder outer members connect together at a bottle holder tip 44. The bottle holder therefore has a bottle holder tip 44 that may clip on a bottle 45. The bottle 45 is preferably a sports drink such as water or isotonic electrolyte fluid.

The invention claimed is:

1. A table tennis caddy for mounting to a table tennis table comprising:

a. a table tennis net assembly including a net mounted on a net frame, wherein the net frame includes a net post extending upward;

b. an outside connection mechanism underneath the net frame disposed toward an exterior portion of the net frame;

c. an inside connection mechanism underneath the net frame is disposed toward an interior portion of the net frame; and d. a ball rack mounted underneath the net frame, wherein the ball rack is connected between the outside connection mechanism and the inside connection mechanism.

2. The table tennis caddy of claim 1, further comprising:

a. a frame hook member connecting to a bottom portion of the net frame;

b. a frame hook opening formed on the frame hook member, wherein the outside connection mechanism is the frame hook opening which faces toward a table tennis table middle portion;

c. a lower frame connected underneath the net frame, wherein the lower frame further includes a lower frame notch that faces the frame hook opening, wherein the lower frame notch is the inside connection mechanism, wherein the ball rack is connected between the frame hook opening and the lower frame notch.

3. The table tennis caddy of claim 2, wherein the frame hook is formed with a flat vertically oriented profile.

4. The table tennis caddy of claim 3, wherein the frame hook is formed with a flat vertically oriented profile, such that the flat vertically oriented profile forms a pair of vertical planes, wherein the frame hook is formed as a pair of metal members.

5. The table tennis caddy of claim 2, wherein the lower frame bridge protrudes upward at a lower frame bridge protrusion so as to create a hook shaped opening where the lower frame bridge protrusion forms a tip of the hook shaped opening.

6. The table tennis caddy of claim 1, wherein the ball rack further comprises a pair of rails including a left rail and a right rail, each sized and shaped for supporting a left and right side of a ping-pong ball.

7. The table tennis caddy of claim 6, wherein the pair of rails have a slope such that table tennis balls roll toward a ball stop.

8. The table tennis caddy of claim 7, wherein the ball stop is made of metal having a spring resilience.

9. The table tennis caddy of claim 7, wherein the pair of rails have between them an intermediate connection which is a rail bridge.

10. The table tennis caddy of claim 7, wherein the ball stop is bridged at a top connector, wherein the ball stop is connected to the pair of rails so that a right ball stop member is connected to the right rail and that a left ball stop member is connected to the left rail, wherein the top connector is sized to connect to the outside connection mechanism.

11. The table tennis caddy of claim 1, further comprising a paddle holder mounted below the ball rack.

12. The table tennis caddy of claim 1, further comprising a bottle mounted to the ball rack.

13. A table tennis caddy for mounting to a table tennis table comprising:

a. a table tennis net assembly including a net mounted on a net frame, wherein the net frame includes a net post extending upward;

b. an outside connection mechanism underneath the net frame disposed toward an exterior portion of the net frame;

c. an inside connection mechanism underneath the net frame this post toward an interior portion of the net frame; and d. a ball rack mounted underneath the net frame, wherein the ball rack is connected between the outside connection mechanism and the inside connection mechanism;

e. a frame hook member connecting to a bottom portion of the net frame;

f. a frame hook opening formed on the frame hook member, wherein the outside connection mechanism is the frame hook opening which faces toward a table tennis table middle portion;

g. a lower frame connected underneath the net frame, wherein the lower frame further includes a lower frame notch that faces the frame hook opening, wherein the lower frame notch is the inside connection mechanism, wherein the ball rack is connected between the frame hook opening and the lower frame notch;

h. a clamp configured to mount the net frame to the table tennis table, wherein the clamp includes a bolt having a bolt tip engaging with an under side of the table, wherein bolt thread passes through a bolt threaded opening in the lower frame.

14. The table tennis caddy of claim 13, further comprising a paddle holder mounted below the ball rack.

15. The table tennis caddy of claim 13, further comprising a bottle mounted to the ball rack.

16. The table tennis caddy of claim 13, wherein the ball rack further comprises a pair of rails including a left rail and a right rail, each sized and shaped for supporting a left and right side of a ping-pong ball.

17. The table tennis caddy of claim 16, wherein the pair of rails have a slope such that table tennis balls roll toward a ball stop.

18. The table tennis caddy of claim 17, wherein the ball stop is made of metal having a spring resilience.

19. The table tennis caddy of claim 18, further comprising a paddle holder mounted below the ball rack.

20. The table tennis caddy of claim 19, further comprising a bottle rack mounted to the ball rack.

* * * * *